US009801415B2

(12) United States Patent
Tu

(10) Patent No.: US 9,801,415 B2
(45) Date of Patent: Oct. 31, 2017

(54) MEMS VAPORIZER

(71) Applicant: Xiang Zheng Tu, San Jose, CA (US)

(72) Inventor: Xiang Zheng Tu, San Jose, CA (US)

(73) Assignee: POSIFA Microsytems, Inc., San Jose, CA (US)

( * ) Notice: Subject to any disclaimer, the term of this patent is extended or adjusted under 35 U.S.C. 154(b) by 102 days.

(21) Appl. No.: 14/329,709

(22) Filed: Jul. 11, 2014

(65) Prior Publication Data

US 2016/0007653 A1 Jan. 14, 2016

(51) Int. Cl.

| | |
|---|---|
| ***A24F 47/00*** | (2006.01) |
| ***B23K 31/02*** | (2006.01) |
| ***G03F 7/20*** | (2006.01) |
| ***F22B 1/28*** | (2006.01) |

(52) U.S. Cl.

CPC ..... *A24F 47/008* (2013.01); *F22B 1/282* (2013.01); *F22B 1/284* (2013.01)

(58) Field of Classification Search

CPC ..... A24F 47/008; B23K 31/02; F22B 1/284; G03F 7/20

USPC ..... 392/403–405

See application file for complete search history.

(56) References Cited

U.S. PATENT DOCUMENTS 4,808,009 A * 2/1989 Sittler ..... F25D 21/02 338/22 SD
5,644,676 A * 7/1997 Blomberg ..... G01J 5/522 219/544
6,136,212 A * 10/2000 Mastrangelo ..... B01J 19/0093 216/27
6,748,164 B1 * 6/2004 Kuzyk ..... A61M 1/0281 392/443
6,821,819 B1 * 11/2004 Benavides ..... H01L 23/4334 257/E23.092
7,088,914 B2 * 8/2006 Whittle ..... A61K 9/007 128/203.27
7,171,975 B2 * 2/2007 Moon ..... B01F 5/061 137/15.01
8,678,012 B2 3/2014 Li et al.
8,739,786 B2 6/2014 Postma et al.
8,742,974 B1 6/2014 Sishtla et al.
8,757,147 B2 6/2014 Terry et al.
2002/0084510 A1 * 7/2002 Jun ..... B81C 1/00119 257/536
2003/0106551 A1 * 6/2003 Sprinkel, Jr. ..... A61M 11/041 128/203.16

(Continued)

OTHER PUBLICATIONS

Innovative Sensor Technology; published Mar. 31 2014 www.ist-ag.com/eh/ist-ag/en/home.nsf/contentview/EB0D258CF05CA816C12578930071FD43.*

*Primary Examiner* — David Angwin
*Assistant Examiner* — Justin Dodson
(74) *Attorney, Agent, or Firm* — James M. Wu; JW Law Group

(57) ABSTRACT

A MEMS vaporizer is described which can be used for electronic cigarettes. The vaporizer mainly composes: a silicon substrate, a micro-channel array, a membrane suspending over the micro-channel array and supported by the silicon substrate, a resistance heater and a resistance temperature sensor are disposed on the membrane. Since the vaporizer is a silicon-based integrated actuator which provides advantages including small size, compact structure, lower power consumption, lower cost, increased reliability, higher precision, and more environmental friendliness.

25 Claims, 4 Drawing Sheets

(56) References Cited

U.S. PATENT DOCUMENTS

| | | | | |
|---|---|---|---|---|
| 2004/0056016 | A1* | 3/2004 | Tian | F27B 17/0025 219/408 |
| 2005/0155615 | A1* | 7/2005 | Rohdewald | A24D 3/14 131/334 |
| 2007/0095507 | A1* | 5/2007 | Henderson | F28D 15/043 165/104.26 |
| 2008/0087629 | A1* | 4/2008 | Shimomura | B23K 26/0661 216/11 |
| 2008/0248613 | A1* | 10/2008 | Chen | B81B 3/0005 438/115 |
| 2008/0257367 | A1* | 10/2008 | Paterno | A24F 47/008 131/328 |

* cited by examiner

MEMS VAPORIZER

FIELD OF THE INVENTION

The present invention relates to a vaporizer used for vaporizing a liquid for a variety of applications. More specifically, the present invention relates to a MEMS (Micro-electro-mechanical-systems) vaporizer and a temperature sensor both integrated in a single silicon substrate which can be used for inhaling the active ingredients of plant material, commonly *cannabis*, tobacco, or other herbs or blends for the purpose.

BACKGROUND OF THE INVENTION

A vaporizer is a device used for vaporizing a liquid for the purpose of inhalation. It is well known that draw-over vaporizers can be used for both civilian and military anesthesia. The earliest vaporizer is an oxford miniature vaporizer which has been in service over 40 years.

Since an electronic cigarette was developed the vaporizer has become popular. The electronic cigarette is a battery-powered vaporizer which simulates tobacco smoking by producing a vapor that resembles smoke. In order to meet the needs of the electronic cigarettes many vaporizers have been designed and manufactured. Some of them can be described in the following US patents.

U.S. Pat. No. 8,742,974 discloses a vaporizer in which the heating device can be configured by fixing heater plates to cover the front, rear, left and right side surfaces and the upper and bottom surfaces of the chamber. The heater plate may be formed by, for example, incorporating a heater in a plate made of aluminum or copper, etc.

U.S. Pat. No. 8,739,786 discloses a portable hand-held vaporizer for electronic cigarette application. The heating element of the vaporizer is a tungsten-based metallic alloy in the form of a coil that is disposed at least partially within the airflow passage. In other embodiments, the heating element is made from nickel-chrome, other types of metals, or metal-based composites that have a generally low thermal resistivity and are generally safe to pass air through for human consumption. In further embodiments, the heating element may be in the form of a plate or other shape, and may be located within a piece of glass or in close proximity to the airflow passage, but yet still able to effectively transfer heat.

U.S. Pat. No. 8,757,147 discloses a personal vaporizer unit which comprises a first wick element and a second wick element having a porous ceramic. The first wick element is adapted to directly contact a liquid held in a reservoir. The reservoir may be contained by a cartridge that is removable from the personal vaporizer unit. A heating element is disposed through the second wick element. An air gap is defined between the first wick element and the second wick element with the heating element exposed to the air gap. Air enters the first wick element through a hole in a housing holding the first wick element.

U.S. Pat. No. 8,678,012 discloses a tobacco solution atomizing device for electronic cigarette which comprises a glass fiber tube, a glass fiber yarn, a heating coil, a cotton cloth layer and a synthetic fiber layer, wherein the glass fiber yarn is insert into the heating coil which is then located inside the glass fiber tube; the ends of the glass fiber silk and two wires which are used to electronically connect the heating coil to the positive and negative electrode connectors extends outward through the glass fiber tube; the cotton cloth layer enwraps the outside wall of the glass fiber tube and reveal ends of the glass fiber yarn are pressed tightly between the cotton cloth layer and the glass fiber tube; a synthetic fiber layer is filled within the annular shape space between the cotton cloth layer and the fixing sleeve for holding the tobacco solution.

It can be seen from the above described vaporizers that each vaporizer generally consists of a small heating element responsible for vaporizing e-liquid, as well as a wicking material that draws liquid in. Along with a battery, the vaporizer is the central component of every electronic cigarette. The vaporizer is assembled by putting together of all separately manufactured parts. Several disadvantages can be found with these vaporizers:

(1) Due to discrete parts, the design, commissioning and installation of the vaporizer is relatively complicated.
(2) Jointing and connecting of the discrete parts significantly reduce the reliability of the vaporizer.
(3) Power consumption is relatively high because the heater is not allowed to contact with the vaporized liquid directly.
(4) No temperature sensor for measuring the temperature of the heating element directly.
(5) Vaporized liquid amount cannot be controlled since no air flow sensor is used for measuring the air flow rate.

Therefore, a need exists to overcome the problems with the prior art as discussed above.

SUMMARY OF THE INVENTION

An objective of the present invention is to provide a MEMS vaporizer which can overcome the above mentioned problems with the prior art.

In order to achieve this goal a MEMS vaporizer is provided by the present invention. The MEMS vaporizer composes: a silicon substrate, a micro-channel array created in the silicon substrate, a membrane suspending over the micro-channel array and supported by the silicon substrate, a resistance heater disposed on one side portion of the membrane and laterally across one end portion of the top of the micro-channel array, a resistance temperature sensor disposed on the membrane and adjacent to the resistance heater, two cavities are recessed in the silicon substrate and connected to the two end exits of the micro-channel array respectively, which all are integrated to be a vaporizer chip, a printed circuit board for packaging the vaporizer chip, a reservoir for inserting the printed circuit board therein so as to dispose one cavity of the vaporizer on its bottom and connect its inside with one end exit of the micro-channel array, a liquid stored in the reservoir, and an air filter disposed on the top of the reservoir which allows air entering the reservoir and a same volume of the liquid in the reservoir entering the micro-channel array continually.

According to the present invention the MEMS vaporizer is installed in an electronic cigarette. The electronic cigarette usually comprises: a housing, a battery; a reservoir, an air flow sensor, a microcontroller, a MEMS vaporizer, a temperature sensor, a small cloud of smoke, an air inlet, a light emitting diode, and a mouthpiece.

In the electronic cigarette the vaporizer is electrically heated for vaporizing the active ingredients of plant materials including *cannabis*, tobacco, or other herbs or blends for the purpose of inhalation. However, they also can be used with pure chemicals when mixed with plant material (e.g. tobacco-free nicotine).

According to the present invention the vaporizer is fabricated using a Micro-Electro-Mechanical Systems technology. The MEMS technology in its most general form can be defined as miniaturized mechanical and electro-mechanical elements that are made using the techniques of micro-fabrication. The most significant advantage of MEMS is their ability to communicate easily with electrical elements in semiconductor chips. Other advantages include small size, compact structure, lower power consumption, lower cost, increased reliability and higher precision.

The vaporizer is operated by filling a liquid in the reservoir, which automatically flows into the micro-channel array due to the surface tension of the liquid in the micro-channel array, and by heating the liquid using an electrical current passing through the resistive heater so that a certain amount of the liquid in the micro-channel array can be vaporized and a cloud of vapor can come out from the outlet of the micro-channel array.

According to the present invention, a method of manufacturing the MEMS vaporizer comprises steps of:

- Providing a silicon substrate having a resistivity ranging from 0.1 to 0.001 ohm-cm and a (100) crystal orientation;
- Depositing a silicon nitride layer on the surface of the silicon substrate by LPCVD (low pressure chemical vapor deposition);
- Performing a lithographic process for creating a silicon revealed rectangular array in the silicon nitride layer;
- Performing an anodization process in a HF solution for converting the silicon revealed rectangular array into a porous silicon array;
- Depositing a bottom silicon nitride layer or the like by LPCVD or PECVD (plasma enhance chemical vapor deposition) on the surface of the porous silicon array;
- Depositing a central polysilicon layer by LPCVD, or a central amorphous silicon layer by PECVD, or a central amorphous silicon carbide layer by PECVD on the surface of the bottom silicon nitride layer or the like;
- Depositing a top silicon dioxide layer or the like on the surface of the central polysilicon layer, or central amorphous silicon layer, or central amorphous silicon carbide;
- Creating a resistance heater on the top of the porous silicon array by sputtering and photolithography;
- Creating a resistance temperature sensor, an electrical interconnection, and several bonding pads on the top of the silicon substrate including the porous silicon array by photolithography process, sputtering, and plating;
- Depositing a passivation layer on the top of the resistance heater and resistance temperature sensor by PECVD which consists of a bottom silicon nitride layer and a top amorphous silicon carbide layer;
- Performing a photolithography process and a dry etching for creating two cavities recessed in the silicon substrate and connecting to the two side end portions of the porous silicon array respectively;
- Etching porous silicon in a dilute KOH solution for creating a micro-channel array and a membrane, which all result in a completed vaporizer chip.

Looking at the vaporizer design and its fabrication method provided by the present invention their advantages can be summarized as the follows:

An advantage of the present invention is that the MEMS vaporizer is fabricated using the techniques of micro-fabrication, which provides with lower cost, increased reliability and higher precision.

Another advantage of the present invention is that the heater of the vaporizer is disposed on a membrane that helps to achieve thermal isolation of the heater from its supporting substrate.

Another advantage of the present invention is that the heater of the vaporizer allows for contacting the heated liquid directly which can result in very high heating efficiency.

Still another advantage of the present invention is that the temperature sensor of the vaporizer allows for measuring the vaporization temperature of the liquid precisely, which is necessary for controlling the heater of the vaporizer.

Still another advantage of the present invention is that the vaporizer allows to be combined with an air flow sensor which can make its applications such as electronic cigarettes digital and intelligent.

Still another advantage of the present invention is that the vaporizer is a silicon-based integrated actuator which provides advantages including small size, lower power consumption, lower cost, increased reliability, higher precision, and environmentally friend.

BRIEF DESCRIPTION OF THE DRAWINGS

The various features of the present invention are shown in the drawings in which like numerals indicate similar elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
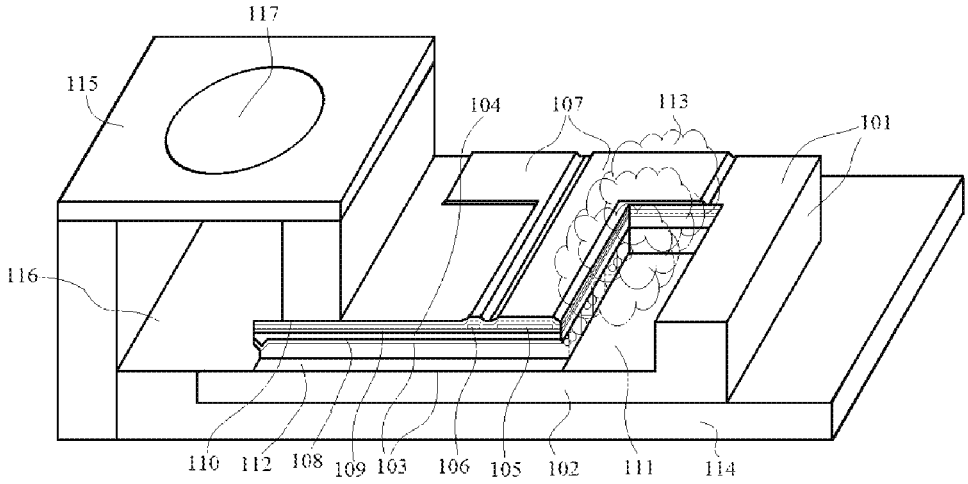
FIG. 1 is a sectional side view of a MEMS vaporizer packaged in a printed circuit board and assembled in a plastic molded reservoir.

As shown in FIG. 1, the present invention provides a MEMS vaporizer composing: a silicon substrate 102, a micro-channel array 103 created in the silicon substrate 102, a membrane 104 suspending over the micro-channel array 103 and supported by the silicon substrate 102, a resistance heater 105 disposed on one side portion of the membrane 104 and laterally across one end portion of the top of the micro-channel array 103, a resistance temperature sensor 106 disposed on the membrane 104 and adjacent to the resistance heater 105, two cavities 111 (another not shown in FIG. 1) are recessed in the silicon substrate 102 and connected to the two end exits of the micro-channel array 103 respectively, which all are integrated to be a vaporizer chip 101, a printed circuit board 114 for packaging the vaporizer chip 101, a reservoir 115 for inserting the printed circuit board 114 with the vaporizer chip 101 therein so as to dispose one cavity on its bottom and connect its inside with one end exit of the micro-channel array 103, a liquid 116 stored in the reservoir 115, and an air filter 117 disposed on the top of the reservoir 115 which allows air entering the reservoir 115 and a same volume of the liquid 116 in the reservoir 115 entering the micro-channel array 103. The liquid filled the micro-channel array 103 is marked as 112.

It is noted that the MEMS vaporizer provided by the present invention is a phase change actuator by which a liquid can be changed to a vapor. This change is governed by the conservation equations of mass, momentum, and energy. Since the change takes place in the micro-channels which have a large surface-to-volume ratio, the capillary force can provide sufficient pressure to push liquid flow in the micro-channels.

Reference to FIG. 1, the liquid 112 in the micro-channel array 103 comes from the reservoir 115. Under the capillary force the liquid is pumped from the reservoir 115 into the micro-channel array 103. An electrical power is dissipated as heat in the resistance heater 105, which then diffuses to the liquid 112 in the micro-channel array 103. The energy balance on the micro-channel array 103 is determined by three terms: (1) the electrical power dissipated as heat in the vaporizer, (2) the sensible heat conducted out of the vaporizer, and (3) the latent heat carried away by liquid vaporizing from the micro-channels.

The first term, the thermal power transferred into the vaporizer by dissipating electrical power in the resistance heater 105, is determined by measuring the voltage drop across the resistance heater 105 and the voltage drop across a power resistor in series with the resistance heater 105. The voltage drop across the power resistor is used to calculate the current through the resistance heater 105 using Ohm's Law. The power $P_{in}$ dissipated in the resistance heater 105 is then:

$$P_{in}=VI \tag{1}$$

where V and I are the voltage and current applied to the resistance heater 105 respectively.

The second term, the sensible heat is conducted out of the vaporizer by the micro-channel array 103, membrane 104 and liquid 112 and 116, which can be determined from the temperatures measured by the temperature sensor 106 positioned on the membrane 104.

The third term in the energy balance, the latent heat carried away by the vaporization of the liquid 112, can be determined by measuring the mass transfer rate from the micro-channel array 103, $J_m$. The latent heat transfer rate from the micro-channels, $Q_l$, is then:

$$Q_l=J_mH_{fg} \tag{2}$$

where $H_{fg}$ is the latent heat of vaporization of the liquid 112.

Micro-channel vaporization efficiency, $\eta_{vap}$, is defined to be the ratio of latent heat transfer rate by vaporization over the power into the vaporizer:

$$\eta_{vap}=Q_l/P_{in} \tag{3}$$

The driving force for liquid flow along the micro-channel array 103 is the capillary pressure $P_c$, given by the equation:

$$P_c=2\gamma\cos\theta/r \tag{4}$$

where γ is the surface tension between the liquid 112 and air, θ is the contact angle between the liquid 112 and the wall of the micro-channel array 103, r is the smallest dimension of the micro-channel array 103.

The liquid flow rate can then be found using force balance, by equating capillary pressure forces driving flow with liquid viscous force retarding flow. With assumptions: steady fluid flow in the micro-channel array 103; neglecting temperature variation in liquid properties; and fully developed laminar flow. The following expression can be obtained:

$$u=(r^2/8\mu\iota)/(2\gamma\cos\theta/r) \tag{5}$$

where u is the liquid velocity, μ is the liquid viscosity, ι is the distance over which liquid has traveled.

The mass flow rate of liquid 112 in the micro-channel array 103 is then:

$$J_m=uA\rho \tag{6}$$

where ρ is the density of the liquid 112, A is the cross-sectional area of the micro-channel array 103.

Knowing the mass flow rate the vapor generating rate in the micro-channel array 103 can be found:

$$V_{vap}=J_m/MR_uT_sP_a \tag{7}$$

where M is the molecular weight of the average liquid 112, $R_u$ is the universal gas constant, $P_a$ is the atmospheric pressures and $T_s$ is the saturation temperatures of the liquid 112.

Several factors have been identified as having a significant impact on the vaporizer performance, which include: the compliance and thermal isolation of the membrane 104; the electrical and thermal properties of the resistance heater 105 and temperature sensor 106; and the length and size of the micro-channel 103.

In order to optimize all these factors the flowing requirements applied to the vaporizer design are appropriate and necessary:

The vaporizer further composes: an electrically insulating layer such as a silicon nitride layer or the like disposed on the top 108 and bottom 109 of the membrane 104, and a passivation layer 110 such as a double layer consisting of a silicon nitride layer and a silicon carbide layer, which covers the top of the resistance heater 105 and the resistance temperature sensor 106.

The micro-channel array 103 of the vaporizer is configured to consist of 1 to 30 micro-channels in which each micro-channel having a length ranging from 50 to 500 micron, a width ranging from 20 to 200 micron, and a height ranging from 10 to 50 micron and two adjacent micro-channels are separated by a trapezium-shape side wall with a top width ranging from 2 to 20 micron;

The membrane 104 of the vaporizer is made of polysilicon layer, or amorphous silicon, or amorphous silicon carbide layer with a thickness ranging from 2 to 5 micron;

The resistance heater 105 of the vaporizer is made of Ta—Al or Ni—Cr alloy thin film, or the like with a resistance ranging from 1 to 100 ohm; The resistance temperature sensor 106 of the vaporizer is made of Ni metal thin film or the like with a resistance ranging from 100 to 1000 ohm.

The MEMS vaporizer provided by the present invention has several applications. A main application is for electronic cigarettes.

Figure 2:
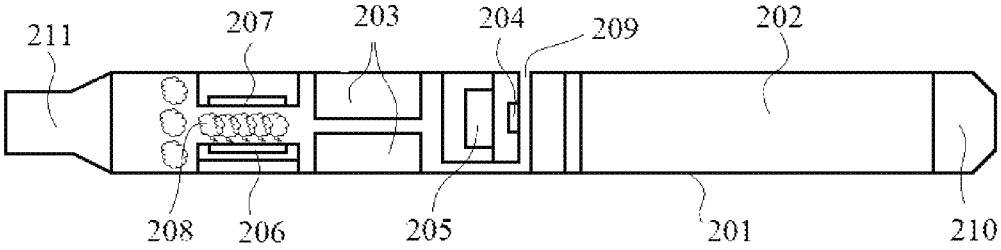
FIG. 2 is a sectional side view of an electronic cigarette with a MEMS vaporizer.

As shown in FIG. 2, an electronic cigarette with a MEMS vaporizer provided by the present invention which usually comprises: a housing 201; a battery 202; a reservoir 203, an air flow sensor 204, a microcontroller 205, a MEMS vaporizer 206, a temperature sensor 207, a small cloud of smoke 208, an air inlet 209, a light emitting diode 210, and a mouthpiece 211. The reservoir 203 is filled with a liquid usually containing a mixture of propylene glycol, vegetable glycerin, nicotine, and flavorings. When inhalation is made by a user an air flow takes place in the housing 201. The air flow starts from the air inlet 209 and flows over the air flow sensor 204 along an air way channel perpendicular to the housing 201. Then the air flow turns to the longitudinal direction of the housing 201, passes through a channel of the reservoir 203, and proceeds to the vaporizer 206. The air flow is detected by the air flow sensor 204 for providing a signal to the microcontroller 205 which turns the buttery 202 on. Then the heater of the MEMS vaporizer 206 is heated so as to start vaporizing the liquid supplied by the reservoir 203, which provides the user a cloud of smoke. When the inhalation is too hard the temperature of the heater of the vaporizer 206 may drop down to below the boiling point of the liquid. In response the temperature sensor 207 sends a signal to the microcontroller 205 for increasing the heating current of the heater and restoring the temperature of the heater to the boiling point of the liquid. As a result the user still has necessary smoke to inhale.

Figure 3:
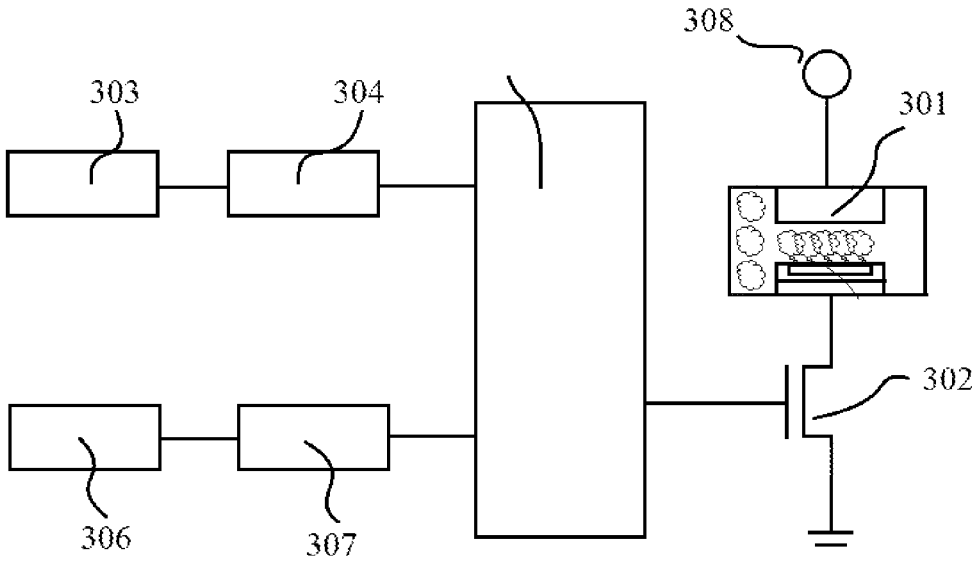
FIG. 3 is a schematic block diagram of a preferred controller circuit for a MEMS vaporizer.

The operation of the MEMS vaporizer in an electronic cigarette provided by the present invention can be run as shown in FIG. 3. The vaporizer 301 is applied with a voltage 308 and connected with a power field-effect transistor (FET) 302. The power field-effect transistor 302 functions as a switch for heating the vaporizer on demand. An air flow sensor 303 is used to measure the air flow rate caused by an inhalation made by a user.

A signal produced by the air flow sensor 303 is amplified by a pre-amplifier 304 and then send to a microcontroller 305 for digital processing. The temperature of the vaporizer 306 is measured by a temperature sensor 306. A signal produced by the temperature sensor 306 is amplified by a pre-amplifier 307 and then send to the microcontroller 305 for digital processing. After digital processing the microcontroller 305 send a pulse-width modulation (PWM) to the gate of the power field-effect transistor 302 which allows the voltage 308 being applied to the vaporizer 306 according to both the air flow rate signal and the heating temperature signal of the vaporizer 306.

It is noted that the MEMS vaporizer has been getting more and more attention due to its compact structure and high heat transfer efficiency. Compared with a conventional vaporizer, the MEMS vaporizer offers higher heat and mass transfer rate. Therefore MEMS vaporizer has been applied in many other fields, such as chemical industry, medical instrument, mechanical engineering and electric chip cooling.

FIG. 4 to FIG. 11 shows the major fabrication steps for manufacturing the MEMS vaporizer. It can be seen that the used technologies are derived from semiconductor integrated circuit (IC) processing. These fabrication steps can be run on any stander IC production lines. Since most of the manufacturing steps are routine IC processes there is no need to describe in detail.

At the start of the process, a silicon substrate 401 with one side polished is provided which has a resistivity ranging from 0.1 to 0.001 ohm-cm and a (100) crystal orientation.

Figure 4:
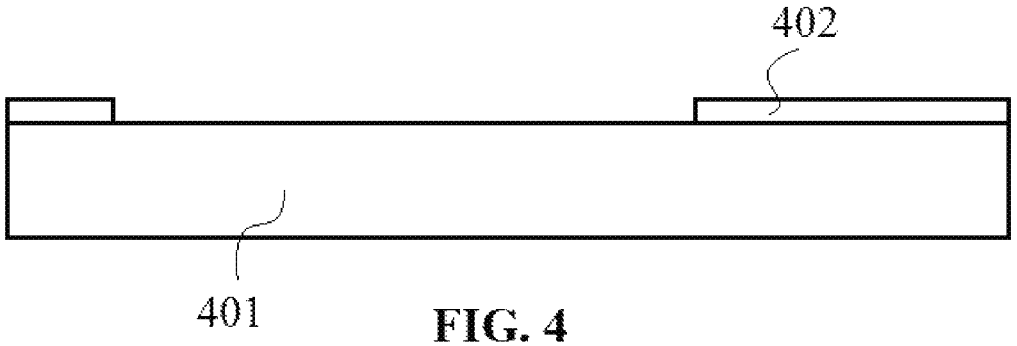
FIG. 4 to FIG. 11 show sectional side views in each fabrication step of a MEMS vaporizer with a MEMS temperature sensor therein.

In step 1, as shown in FIG. 4, a silicon nitride layer is deposited on the surface of the silicon substrate 401 by LPCVD (low pressure chemical vapor deposition), which has a thickness ranging from 2000 to 3000 angstroms. Then a lithographic process is performed for creating a silicon-revealed rectangular array 402 in the silicon nitride layer. Each silicon-revealed rectangular region has a length ranging from 50 to 500 micron, a width ranging from 20 to 200 micron, and two adjacent silicon-revealed rectangular regions are separated by a width ranging from 2 to 20 micron.

Figure 5:
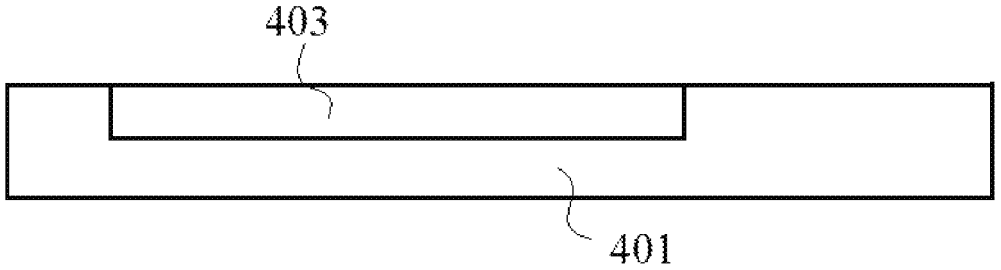

In step 2, as shown in FIG. 5, an anodization process is carried out in a HF solution. From this step the silicon-revealed rectangular array 402 is converted into a porous silicon array 403. The anodization process is performed in a two-chamber cell. The HF solution consists of one or two parts 48 wt % HF and 1 part ethanol or isopropyl alcohol (IPA). The used anodic current density is ranging from 40 to 80 mA/cm.sup.2.

Each porous silicon rectangular region of the porous silicon array 403 has a length ranging from 50 to 500 micron and a width ranging from 20 to 200 micron. The thickness of the porous silicon layer depends upon the anodic current intensity and the process timing. The resulted thickness of the porous silicon layer is ranging from 10 to 50 micron. Two adjacent porous silicon rectangular regions are separated by a trapezium side wall with a top width ranging from 2 to 20 micron.

Figure 6:
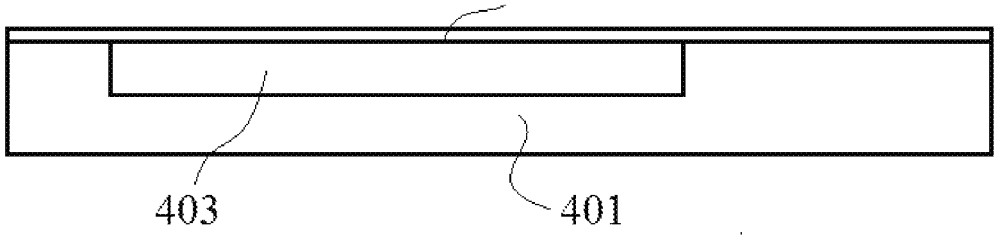

In step 3, as shown in FIG. 6, a bottom silicon nitride layer or the like 404 is deposited by LPCVD on the surface of the silicon substrate 401 including the porous silicon array 403. The bottom nitride layer or the like 404 can also be deposited by PECVD (plasma enhance chemical vapor deposition), which allows depositing a silicon nitride layer or the like with a lower residue stress. The thickness of the bottom silicon nitride layer or the like 404 is ranging 1000 to 8000 angstrom.

In step 4, as shown in FIG. 6, a polysilicon layer 405 is deposited by LPCVD on the surface of the bottom silicon nitride layer or the like 404. As an alternative an amorphous silicon layer 405 is deposited by PECVD on the surface of the bottom silicon nitride layer or the like 404. Still as an alternative an amorphous silicon carbide layer 405 is deposited by PECVD on the surface of the bottom silicon nitride layer or the like 404.

The thickness of the polysilicon layer, or amorphous silicon layer, or amorphous silicon carbide layer 405 is ranging from 2 to 5 micron. It is noted that the polysilicon layer, or amorphous silicon layer, or amorphous silicon carbide layer 405 functions as the basic structure material for the membrane of the vaporizer which will be formed.

Figure 7:
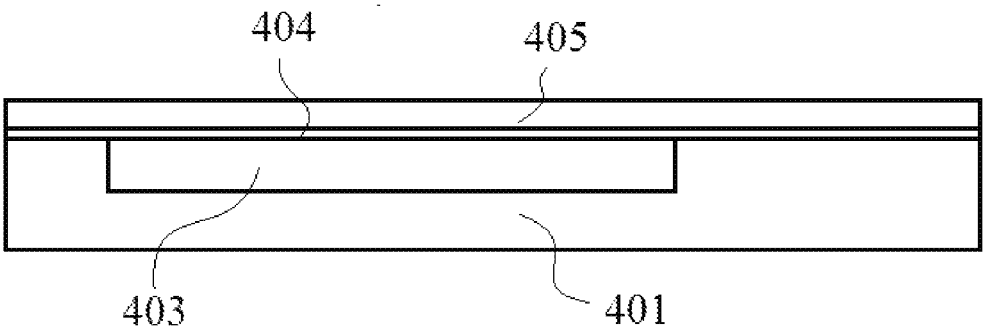

In step 4, as shown in FIG. 7, a top silicon nitride layer or the like 406 is deposited by LPCVD or PECVD on the surface of the polysilicon layer, or amorphous silicon layer, or amorphous silicon carbide layer 405, which has a thickness ranging from 1000 to 8000 angstrom. It can be seen that from this step a sandwich structure is formed in which the central layer 406 is sandwiched between the bottom layer 404 and the top layer 405. It is noted that such sandwich structure helps to prevent the structure from bending owing to the residue stresses of the three layers forming the sandwich structure.

Figure 8:
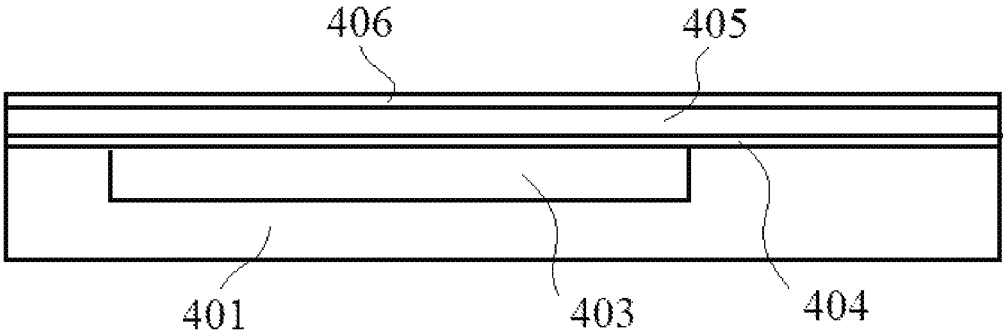

Reference to FIG. 8, in step 5, at least a resistance heater 407 is created on the top of the porous silicon layer 403 by sputtering and photolithography process. The heater is made of Ta—Al or Ni—Cr alloy thin film, or the like. The sputtering target consists of Al-55% and Ta-45% or Ni-80% and Cr-20%. The Ni—Cr alloy is etched using Ni-Chrome etchant (TFE). The resistance of the created heater 407 is ranging from 1 to 100 ohm.

Then a Ni metal thin film resistance temperature sensor 408 is created on the top of the porous silicon array 403 and adjacent to the resistance heater 407. Since there is no etchant available for wet etching Ni metal a lift-off process is needed. Using a photo-resist pattern as mask a Ni metal thin film deposition is performed by sputtering. In order to increase the thickness of the Ni metal thin film an additional chemical plating process may be performed hereafter. After removing the photo-resist pattern in a micro-strip a Ni metal thin film sensor 408 is left on the top of the porous silicon array 403. The resistance of the temperature sensor 408 is ranging from 100 to 1000 ohm. The Ni metal is chosen for the temperature sensor 408 because it has a higher temperature coefficient of bulk resistance of $6.8\times10^{-3}/°$ C., compared to the $3.9\times10^{-3}/°$ C. of bulk platinum. It is noted that in this step a Ni metal thin film interconnection line and four Ni metal bonding pads are also created, which not only connect the Ni metal thin film resistance temperature sensor 408 but also the Ta—Al or Ni—Cr alloy thin film, or the like resistance heater 407.

Figure 9:
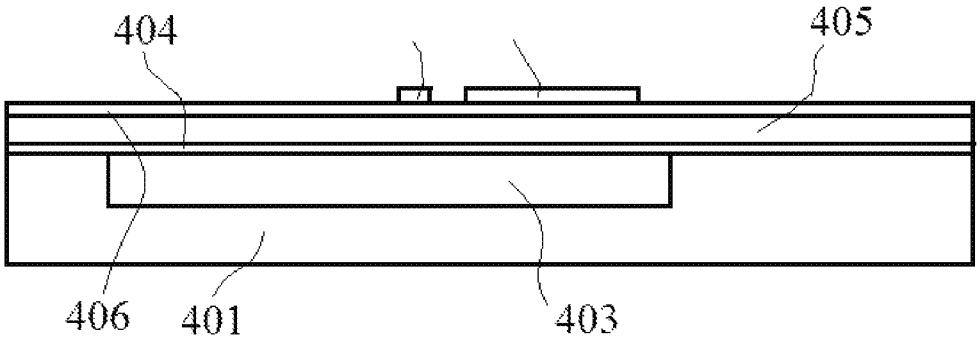

Reference to FIG. 9, in step 6, a silicon nitride layer 409 and amorphous silicon carbide layer 410 are successively deposited by PECVD on the surface of the resistance heater 407 and resistance temperature sensor, which are used as a passivation layer. The silicon nitride layer 409 has a thickness ranging from 2000 to 5000 angstrom and the amorphous silicon carbide layer 410 has a thickness ranging from 2000 to 5000 angstrom.

Figure 10:
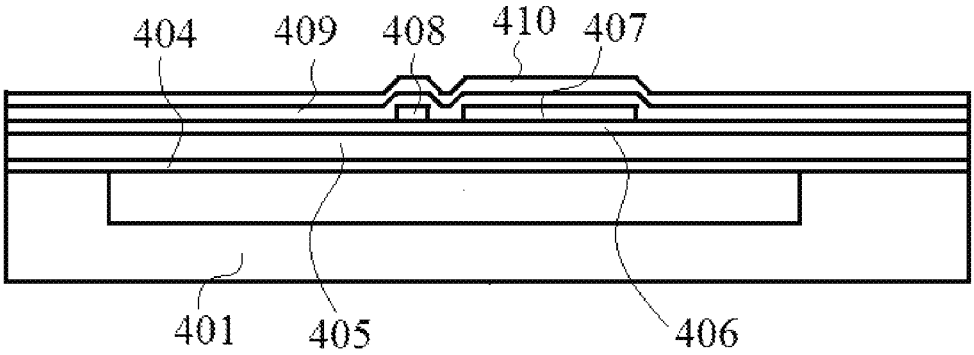

Reference to FIG. 10, in step 7, a 3-5 micron-thick photo-resist pattern is formed. This pattern is used as a mask for dry etching. The dry etching is performed to reveal the Ni metal bonding pads. Then the dry etching is continued to create two cavities 412 and 413. The cavities 412 and 413 pass through all deposited surface layers on the silicon substrate 401 and go deep into the silicon substrate 401 so as to meet the end portion of the porous silicon array 403. The length of the cavities 412 and 413 equals to the width of the porous silicon array 403 and the width is ranging from 200 to 400 micron.

Figure 11:
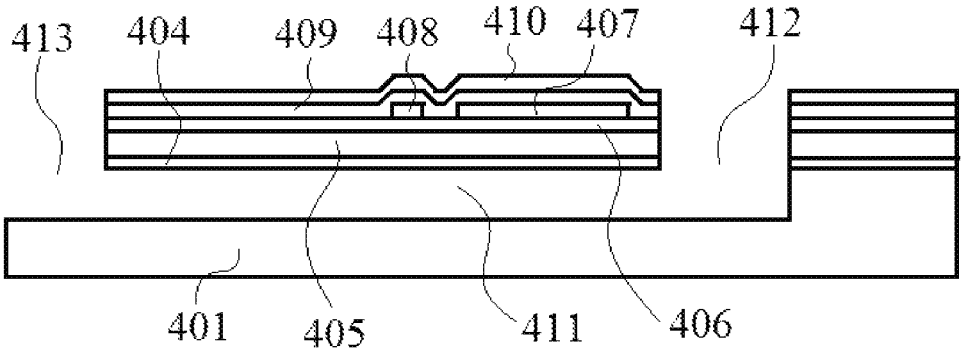

Reference to FIG. 11, step 8 is for selectively etching the porous silicon in the porous silicon array 403 in a diluted KOH solution. Since the diluted KOH solution can not etch silicon nitride and etches silicon at an extremely small rate, this step results in a micro-channel array 411 and a suspending membrane consisting of the bottom and the top silicon nitride layer or the like 404 and 406, and the central polysilicon layer, or central amorphous silicon layer, or amorphous silicon carbide layer 405. It is noted that a vaporizer chip is completed by now, which comprises of the silicon substrate 401, the micro-channel array 411, the membrane consisting of the bottom silicon nitride layer or the like 404, the central polysilicon layer, or central amorphous silicon layer, or central amorphous silicon carbide layer 405, the top silicon nitride layer or the like 406, the resistance heater 407, the resistance temperature sensor 408, four bonding pads (not shown in FIGS. 4 to 11), and two cavities 412 and 413. The membrane suspends over the micro-channel array 411 and supports the resistance heater 407 and the resistance temperature sensor 408. The two end exits of the micro-channel array 411 are open to the two cavities 412 and 413 respectively, which allows a liquid flowing from the cavity 413 to the micro-channel array 411 and a vapor flowing from the micro-channel array 411 to the cavity 412.

It is noted that step 8 results in a completed vaporizer chip which is marked by 101 in FIG. 1.

Back to FIG. 1, for step 9, the completed vaporizer chip 101 is packaged on a printed circuit board (PCB) 114 by mounting and wire bonding, which has a jack connecting to a control circuit (not shown in FIG. 1).

Still reference to FIG. 1, for step 10, the printed circuit board 114 is inserted into a molted plastic reservoir 115 so that the liquid 112 in the micro-channel array 103 of the vaporizer chip 101 can be continually supplemented from the liquid 116 stored in the reservoir 115.

As shown in FIG. 1, there is an air filter 117 disposed on the top of the reservoir 115, which allows air entering the reservoir 115 and a same volume of the liquid 116 entering the micro-channel array 103. Capillarity is the force that drives the liquid 116 stored in the reservoir 115 into the micro-channel array 103 and moves the liquid 112 filled in the micro-channel array 103 to the vaporization region under the resistance heater 105. The air filter 107 is made of PTFE, regenerated cellulose, nylon, cellulose nitrate, polycarbonate, aluminum oxide, etc. It is noted that one cavity (not shown in FIG. 1) of the micro-channel array 103 is located on the bottom of the reservoir 115 and the gap between the membrane 104 over the micro-channel array 103 and the reservoir 115 is sealed with a resin so that there is no liquid leak therefrom.

The embodiments and examples set forth herein were presented in order to best explain the present invention and its particular application and to thereby enable those skilled in the art to make and use the invention. However, those skilled in the art will recognize that the foregoing description and examples have been presented for the purposes of illustration and example only. The description as set forth is not intended to be exhaustive or to limit the invention to the precise form disclosed. Many modifications and variations are possible in light of the above teaching without departing from the spirit of the forthcoming claims.

What is claimed is:

1. A MEMS vaporizer comprising:

a silicon substrate, a micro-channel array created in the silicon substrate, a membrane supported by the silicon substrate wherein at least a portion of the membrane suspends over the micro-channel array, a resistance heater disposed directly over one side portion of the membrane and situated adjacent to one end portion of the micro-channel array for thermal coupling to the micro-channel, a resistance temperature sensor disposed directly over the membrane and adjacent to the resistance heater, two cavities created in the silicon substrate and directly connected to two end exits of the micro-channel array respectively, wherein the two cavities are integrated to be a part of a vaporizer chip, a printed circuit board for housing the vaporizer chip, a reservoir for inserting the printed circuit board with the vaporizer chip therein so as to have one of the two cavities configured to connect with one end exit of the micro-channel array via a fluid communication, a liquid stored in the reservoir, and an air filter disposed directly on the reservoir wherein the air filter allows a volume of air entering the reservoir to be same as a volume of the liquid leaving the reservoir via the micro-channel array.

2. The MEMS vaporizer of claim 1, wherein said vaporizer is installed in an electronic cigarette for vaporizing e-liquid containing a mixture of propylene glycol, vegetable glycerin, nicotine, and flavorings.

3. The MEMS vaporizer of claim 1, wherein said liquid contains the active ingredients of *cannabis* for inhalation.

4. The MEMS vaporizer of claim 1, wherein said liquid contains an herb, oil, or wax for inhalation.

5. The MEMS vaporizer of claim 1, wherein said liquid is driven to flow from the reservoir to the micro-channel array by capillary force that results from the interaction of cohesion of molecules of the liquid to each other and adhesion of these molecules to the constructing material of the micro-channel array.

6. The MEMS vaporizer of claim 1, wherein said resistance heater is configured to heat the liquid in the micro-channel array to boiling temperature so as to enable phase change from liquid to vapor.

7. The MEMS vaporizer of claim 1, wherein said resistance temperature sensor is disposed with the resistance heater thermally coupled to the membrane, which allows for measuring the temperature of the resistance heater directly and accurately.

8. The MEMS vaporizer of claim 1, wherein said membrane has a sandwiched structure including a bottom silicon nitride layer, a central polysilicon layer disposed on the bottom silicon nitride layer, and a top silicon nitride layer disposed over the central polysilicon layer.

9. The MEMS vaporizer of claim 1, wherein said membrane has a sandwiched structure including a bottom silicon nitride layer, a central amorphous silicon layer disposed over the bottom silicon nitride layer, and a top silicon nitride layer disposed over the central amorphous silicon layer.

10. The MEMS vaporizer of claim 1, wherein said membrane has a sandwiched structure consisting of a bottom silicon nitride layer, a central amorphous silicon carbide layer disposed over the bottom silicon nitride layer, and a top silicon nitride layer disposed over the central amorphous silicon carbide layer.

11. The MEMS vaporizer of claim 1, wherein said resistance heater and resistance temperature sensor are passivated by coating a bottom silicon nitride layer, and a top amorphous silicon carbide layer on their surface.

12. The MEMS vaporizer of claim 1, wherein said vaporizer is configured as: the micro-channel array consisting of 1 to 30 micro-channels in which each micro-channel has a length ranging from 50 to 500 micron, a width ranging from 20 to 200 micron, and a height ranging from 10 to 50 micron, and two adjacent micro-channels are separated by a trapezium-shape side wall with a width ranging from 2 to 20 micron.

13. The MEMS vaporizer of claim 8, wherein said central polysilicon layer has a thickness ranging from 2 to 5 micron, both said bottom and top layers have a thickness ranging from 1000 to 8000 angstrom.

14. The MEMS vaporizer of claim 9, wherein said central amorphous silicon layer has a thickness ranging from 2 to 5 micron, said bottom and top layer have a thickness ranging from 1000 to 8000 angstrom.

15. The MEMS vaporizer of claim 10, wherein said central amorphous silicon carbide layer has a thickness ranging from 2 to 5 micron, said bottom and top layer have a thickness ranging from 1000 to 8000 angstrom.

16. The MEMS vaporizer of claim 1, wherein said the resistance heater is made of Ta—Al or Ni—Cr alloy thin film which has a resistance ranging from 1 to 100 ohm.

17. The MEMS vaporizer of claim 1, wherein said the resistance temperature sensor is made of Ni metal thin film which has a resistance ranging from 100 to 1000 ohm.

18. The MEMS vaporizer of claim 1, wherein said air filter is made of PTFE, regenerated cellulose, nylon, cellulose nitrate, polycarbonate, or aluminum oxide.

19. A micro-electro-mechanical-systems ("MEMS") vaporizer comprising:

a micro-channel created in a substrate, the micro-channel having with a first end and a second end;

a membrane coupled to the substrate and a portion of the membrane situated from vicinity of the first end of the micro-channel to vicinity of the second end of the micro-channel;

a resistance heater disposed on the membrane and situated adjacent to the first end of the micro-channel for thermal coupling between the resistance heater and the micro-channel;

a resistance temperature sensor disposed over the membrane and adjacent to the resistance heater;

a first cavity created in the substrate and directly coupled to the first end of the micro-channel;

a second cavity created in the substrate and directly coupled to the second end of the micro-channel; and a reservoir coupled to the substrate and configured to couple to the second end of micro-channel for facilitating passage of fluid from the reservoir to the first cavity via the micro-channel.

20. The MEMS vaporizer of claim 19, wherein said membrane has a sandwiched structure having a bottom silicon nitride layer, a central polysilicon layer disposed on the bottom silicon nitride layer, and a top silicon nitride layer disposed over the central polysilicon layer.

21. The MEMS vaporizer of claim 20, wherein said central polysilicon layer has a thickness ranging from 2 to 5 micron, both said bottom and top polysilicon layers have a thickness ranging from 1000 to 8000 angstrom.

22. The MEMS vaporizer of claim 19, wherein said membrane has a sandwiched structure including a bottom silicon nitride layer, a central amorphous silicon layer disposed over the bottom silicon nitride layer, and a top silicon nitride layer disposed over the central amorphous silicon layer.

23. The MEMS vaporizer of claim 22, wherein said central amorphous silicon layer has a thickness ranging from 2 to 5 micron, said bottom and top layers have a thickness ranging from 1000 to 8000 angstrom.

24. The MEMS vaporizer of claim 19, wherein said membrane has a sandwiched structure consisting of a bottom silicon nitride layer, a central amorphous silicon carbide layer disposed over the bottom silicon nitride layer, and a top silicon nitride layer disposed over the central amorphous silicon carbide layer.

25. The MEMS vaporizer of claim 24, wherein said central amorphous silicon carbide layer has a thickness ranging from 2 to 5 micron, said bottom and top layers have a thickness ranging from 1000 to 8000 angstrom.

* * * * *